United States Patent [19]

De Laat

[11] Patent Number: 4,474,650

[45] Date of Patent: Oct. 2, 1984

[54] METHOD OF MANUFACTURING A MOTHER MATRIX

[75] Inventor: Antonius W. M. De Laat, Eindhoven, Netherlands

[73] Assignee: U.S. Philips Corporation, New York, N.Y.

[21] Appl. No.: 541,822

[22] Filed: Oct. 14, 1983

[30] Foreign Application Priority Data

Oct. 14, 1982 [NL] Netherlands ..... 8203975
Sep. 28, 1983 [NL] Netherlands ..... 8303315

[51] Int. Cl.[3] ..... C25D 1/10; C25D 1/20

[52] U.S. Cl. ..... 204/5; 204/38 B; 204/38 E

[58] Field of Search ..... 204/5, 3, 4, 38 B, 38 E, 204/38 R

[56] References Cited

U.S. PATENT DOCUMENTS 4,124,672 11/1978 Jarsen ..... 204/5
4,211,617 7/1980 Hunyar ..... 204/5

*Primary Examiner*—Thomas Tufariello
*Attorney, Agent, or Firm*—Norman N. Spain

[57] ABSTRACT

A method of manufacturing a metal mother matrix in which a master disk, which is a supporting disk, carrying on one side a layer of a positive photoresist in which an information track is provided, is provided with a metal peel, first by electroless deposition and then by electrodeposition, the metal peel is separated from the master disk, the remainders of the photoresist present on the father matrix thus obtained are dissolved and a metal copy, which is a mother matrix, is manufactured by electrodeposition from the father matrix, characterized in that the photoresist is made electrically conductive by means of exposure to light.

2 Claims, 3 Drawing Figures

METHOD OF MANUFACTURING A MOTHER MATRIX

Figure 1:
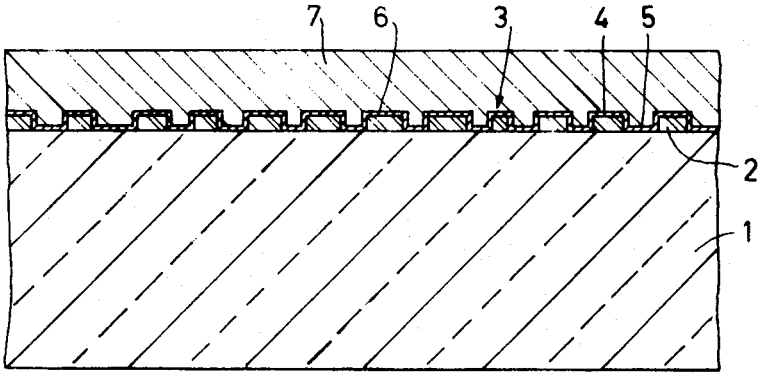

The invention relates to a method of manufacturing a mother matrix in which a master disk, which is a flat supporting disk carrying on one side a layer of a positive photoresist in which an information track is provided, is provided on the side of the photoresist with a metal peel, first by electroless desposition and then by electrodeposition, the metal peel is separated from the master disk resulting into a father matrix which comprises an information track which is the negative of that of the master disk, the photoresist adhering to the surface of the father matrix are dissolved and a metal copy is made from the father matrix by electrodeposition, the resulting mother matrix comprising an information track which is identical to that of the master disk.

Such a method is known from Netherlands patent application No. 7611395 in the name of Applicants. The the photoresist adhering to the father matrix are dissolved by treatment with an organic solvent, in particular a mixture of isopropyl alcohol and methyl isobutyl ketone.

Only one father matrix can be manufactured from the master disk. Positive copies in synthetic resin can be made from the said father matrix by using, for example, a moulding process or an injection moulding process. A positive copy is a copy the information track of which is identical to that of the master disk. In order to increase the number of matrices with which copies in synthetic resin are manufactured, several metal copies, the so-called mother matrices, are manufactured from the father disk by electrodeposition. Further copies, the so-called son matrices, are then made from each mother matrix, also by electrodeposition. The copies in synthetic resin made with the son matrices are positive copies.

The electrodeposition process for the manufacture of a mother matrix or son matrix is a known process. By way of example, a mother matrix is manufactured by dipping the father matrix in an electrode-position (galvanic) bath of an aqueous acid solution of a metal salt, for example, nickel sulfamate. The father matrix is connected to the cathode of the electrodeposion (galvanic) bath. Upon current passage, an Ni-peel is deposited on the father matrix on the side of the information track. After separating the Ni-peel, the mother matrix has been obtained the information track of which is the negative of that of the father matrix. In order to be able to readily perform such a separation, a father matrix is used the surface of which is passivated by a treatment with an oxidation agent.

It has been found that excellent copies in synthetic resin can be manufactured with the father matrix obtained according to the method described in the above-mentioned Netherlands patent application No. 7611395. Problems are encountered when metal copies, hence mother matrices, are made from the father matrix by means of an electrodeposition process. The surface of the mother matrix shows a bad quality and comprises cavities which are many times larger than the width and depth of the information track. This track may be a traditional sound track such as in grammophone records. The information track preferably is an optically readable track with audio or video information. Such an optically readable track has an extremely fine structure of information areas situated alternately at a higher level and at a lower level. The areas have small dimensions of, for example, 0.2 to 3 μm. The difference in height between the areas is 0.1 to 0.2 μm. The information track is spiral-like or is constructed from concentric circles.

The applicant has discovered that the bad quality of the surface of the mother matrix is caused by the fact that the surface of the father matrix on the side of the information track does not show a homogeneous electric conductivity. More in particular it has been concluded that upon current passage during the electrodeposition process some parts of the surface of the father matrix have a smaller electric conductivity and are electrically screened to a certain extent. The current lines from the anode to the cathode deflect at the area of the above-mentioned parts. In Applicants opinion, the each of homogeneous conductivity over the surface of the father matrix is the result of the fact that the father matrix during the manufacture has been in contact with the photoresist material. Portion of the photoresist adhering to the father matrix after separating from the the master disk can never be removed entirely by the treatment with solvents. The treatment would have to be repeated many times, which results in an absolutely uneconomic process. Moreover, as a result of the treatment which solvents, very persistent drying spots caused by the evaporation of the solvent are formed at the surface of the father matrix. These extremely thin remaining portions of the resist material also contribute to the locally poor electrically conductive character of the surface of the father matrix. Photoresist material, as the word implies, is a resistive material.

It is the object of the invention to provide a method which does not exhibit the above-mentioned disadvantages. More in particular the invention relates to a method of the type mentioned in the opening paragraph which is characterized in that the photoresist is made electrically conductive by means of exposure to light.

By exposure to, for example, ultraviolet light the photoresist molecules are decomposed. Covalent bonds are interrupted. Ionogenic groups are formed. The photoresist obtains a hydrophilic character. Electrolyte solutions can penetrate into it. Even comparatively thick layers of resist mateial become current conductive in an alkaline aqueous medium.

In principle, the photoresist may be exposed to light at any instant in the above-mentioned process. For example, the father matrix, after the treatment with organic solvents, can be exposed to light, the resist material present inter alia in the drying spots being converted into an electrically conductive material. It is also possible to expose the photoresist layer of the master disk to light. In that case the remainders of the photoresist present on the surface of the father matrix are dissolved in an aqueous medium, in particular an aqueous alkaline medium. Very suitable is the use of a developing liquid for the exposed photoresist, for example, an aqueous solution of NaOH and $Na_4P_2O_7$. The remaining drying spots are not annoying because they contain the electrically conductive photoresist material.

It is to be noted that it is known per se, for example, from Xerox Disclosure Journal, Vol. 7, No. 4, 1982, pp. 293,294, to remove photoresist material by using a second exposure step and dissolving the exposed material in a developing liquid. The subject matter of the said reference deals with a "lift-off" technique used in semiconductor technology. According to a "lift-off" technique a metal layer overlying a photoresist material is removed by dissolution of the photoresist material. In a lift-off technique the penetration of the solvent for the resist material is an important factor. The said reference does not relate to an electrodeposition (galvanic) technique as in the present case and to the problems of current conduction as described hereinbefore.

Figure 2:
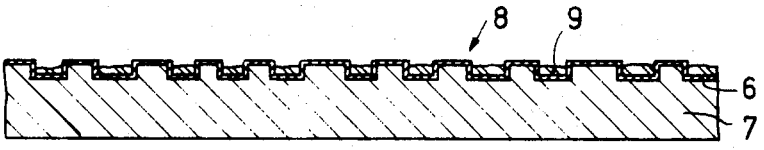
Figure 3:
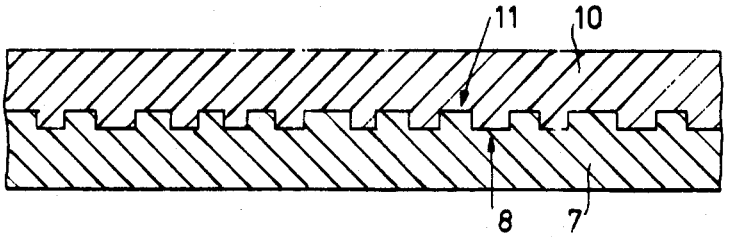

The invention will be described in greater detail with reference to the example and the drawing, in which FIG. 1 is a cross-sectional view of a master disk used in the method according to the invention having a metal layer, FIG. 2 is a cross-sectional view of a father matrix on which remainders of photoresist are present, FIG. 3 is a cross-sectional view of a father matrix having an electrodeposited metal layer, the latter forming a mother matrix.

EXAMPLE

Reference numeral 1 in FIG. 1 denotes a 5 mm thick glass plate having a diameter of 240 nm. The glass plate is provided on one side with a photoresist layer 2 having a layer thickness of 0.12 μm. The positive photoresist used is a derivative of naphthoquinone diazide obtainable under the trade name of Hunt Waycoat type HPR 204. By exposure to light in the form of a pattern and development, a spiral-like information track 3 is provided which has a crennelated profile of information areas 4 situated at a higher level alternated by information areas 5 situated at a lower level in the resist layer. The longitudinal dimensions of the areas vary from approximately 0.2 to 3 μm in accordance with the stored information. The difference in height between the information areas is approximately 0.1 μm. The areas are optically readable. A metal layer 6 is provided on the resist layer 2 comprising the information track 3 by electroless deposition. A suitable metal layer is an Ag-layer or Ni-layer. Examples of an electroless deposition process are a vapour-deposition process, a sputtering process or a chemical plating process. According to the last-mentioned process the photoresist layer is treated with an aqueous solution of a salt of the desired metal and subsequently or simultaneously with an aqueous solution of a reduction agent in which the metal ion is reduced to a metal atom and a metal layer is formed. Thus, for example, the photoresist layer may be treated with an neutral or weakly acid aqueous solution of $NiSO_4$ and subsequently or simultaneously with an aqueous solution of hypophosphite or borohydride. Such metallisation processes have been well known for many years. Reference may be made to, for example, "The Technology of aerosol plating", by Donald J. Levy in Technical Proceedings 51st Annual Convention American Electroplaters' Society, St. Louis, 1964, pp. 139–149.

The layer 6 shown in FIG. 1 is a vapour-deposited Ag-layer having a thickness of 0.12 μm. A nickel layer 7 in a thickness of 400 μm is grown on the silver layer 6 by electrodeposition. Nickel layer 7 and the silver layer 6 bonded thereto are removed from the glass plate 1 provided with photoresist layer 2. Portions 9 of the photoresist layer 2 adhere to the father matrix shown in FIG. 2 and formed of the silver layer 6 and the nickel layer 7 bonded thereto. The information track 8 present in the father matrix is a copy of information track 3 (FIG. 1).

The remainders of the photoresist layer 9 are dissolved by treating the father matrix with a mixture of isopropyl alcohol and methyl isobutyl ketone. The surface of the father matrix is then exposed to the light of a 500 W super high pressure Hg lamp for 4 minutes. A metal copy (mother matrix) is manufactured from the father matrix by first removing the silver layer 6. For this purpose the silver layer is dissolved in an aqueous alkaline solution of $H_2O_2$. The released surface of nicklel layer 7 is passivated by a treatment with an aqueous solution of $K_2Cr_2O_7$ and the nickel layer is then provided by electrodeposition with an Ni-layer 10 (FIG. 3) on the side of information track 8. After separating Ni-layer 10 which comprises an information track 11 which is a copy of information track 8, the mother matrix is obtained. In the same manner as described hereinbefore, son matrices can be manufactured from said master matrix by electrodeposition. By means of the son matrix, synthetic resin information carriers are manufactured, for example, by using an injection moulding process. The master matrix, the son matrix and the synthetic resin information carriers all exhibit an excellent surface quality.

The same good results are obtained if the photoresist material is exposed to light in an earlier stage of the process. In a suitable embodiment the photoresist material of the master disk, after an information track has been provided, is exposed to UV light originating from a 500 W super high pressure Hg lamp for 4 minutes. A silver layer in a thickness of 0.12 μm is vapour-deposited on the exposed photoresist layer. A nickel layer in a thickness of 400 μm is electrodeposited on the silver layer. Remainders of exposed photoresist are present on the father matrix thus manufactured. The remainders are dissolved by a treatment with a solution of 10 g of NaOH and 50.5 g of $Na_4P_2O_7.10\ H_2O$ in 2 liters of water. Rinsing with water is then carried out. A metal copy of the father matrix is then manufactured by electrodeposition as described hereinbefore. The resulting mother matrix has an excellent surface quality.

What is claimed is:

1. A method of manufacturing a mother matrix in which a flat supporting master disk, carrying on one side a layer of a positive photoresist in which an information track is provided, is provided on the side of the photoresist with a metal peel, first by electroless deposition and then by electrodeposition, the metal peel is separated from the master disk thereby forming a father matrix provided with an information track which track is the negative of that of the master disk, photoresist adhering to the surface of the father matrix is dissolved and a metal copy is made from the father matrix by electrodeposition, thereby forming a mother matrix provided with an information track which is identical to that of the master disk, characterized in that the photoresist is made electrically conductive by means of exposure of light.

2. A method as claimed in claim 1, characterized in that after the exposure to light the photoresist is treated with an aqueous alkaline solution.

* * * * *

UNITED STATES PATENT AND TRADEMARK OFFICE

CERTIFICATE OF CORRECTION

PATENT NO. : 4,474,650

DATED : October 2, 1984

INVENTOR(S) : ANTONIUS W.M. De LAAT

It is certified that error appears in the above-identified patent and that said Letters Patent is hereby corrected as shown below:

In the claims:

Column 4, line 59, "of" should be --to--.

Signed and Sealed this

*Twelfth* Day of *March 1985*

[SEAL]

*Attest:*

DONALD J. QUIGG

*Attesting Officer* *Acting Commissioner of Patents and Trademarks*